US007069659B1

(12) United States Patent
Rye

(10) Patent No.: US 7,069,659 B1
(45) Date of Patent: Jul. 4, 2006

(54) SLIDING TRIM MARKING DEVICE AND METHOD OF USING SAME

(76) Inventor: Steven G. Rye, 3534 Markgraft, Fall Creek, WI (US) 54742

( * ) Notice: Subject to any disclaimer, the term of this patent is extended or adjusted under 35 U.S.C. 154(b) by 0 days.

(21) Appl. No.: 10/865,516

(22) Filed: Jun. 9, 2004

(51) Int. Cl.
*G01D 21/00* (2006.01)
*G01B 5/14* (2006.01)

(52) U.S. Cl. ..... 33/194; 33/464; 33/482; 33/562

(58) Field of Classification Search ..... 33/194, 33/464, 482, 562
See application file for complete search history.

(56) References Cited

U.S. PATENT DOCUMENTS

| | | | | | |
|---|---|---|---|---|---|
| 924,660 | A * | 6/1909 | Hodgin | 33/464 |
| 1,031,517 | A | 7/1912 | Boyce | |
| 1,192,418 | A | 8/1916 | Hallberg | |
| 1,634,178 | A | 6/1927 | Edmondson | |
| 2,473,639 | A | 6/1949 | Erickson | |
| 3,197,874 | A | 8/1965 | Fox | |
| D287,944 | S | 1/1987 | Hewston | |
| 4,989,336 | A | 2/1991 | Waltrip et al. | |
| 5,412,875 | A * | 5/1995 | Hilderbrandt | 33/374 |
| 5,737,844 | A | 4/1998 | Brumley | |
| 5,775,036 | A * | 7/1998 | Stanley, Sr. | 33/194 |
| 6,134,797 | A * | 10/2000 | Boyce | 33/464 |
| 6,237,237 | B1 * | 5/2001 | McKenna et al. | 33/374 |
| 6,282,852 | B1 * | 9/2001 | Walcker | 33/194 |
| 6,305,091 | B1 | 10/2001 | Tegels | |
| 6,341,427 | B1 * | 1/2002 | Tepley | 33/194 |
| 6,442,853 | B1 * | 9/2002 | Hale et al. | 33/194 |
| 6,810,592 | B1 * | 11/2004 | Oldfield, Jr. | 33/194 |
| 2003/0131486 | A1 | 7/2003 | Wallace | |
| 2004/0000061 | A1 * | 1/2004 | Tuthill | 31/194 |

* cited by examiner

*Primary Examiner*—Christopher W. Fulton
(74) *Attorney, Agent, or Firm*—Anthony J. Bourget

(57) ABSTRACT

A trim marking device and method to gauge the span between opposing jambs for subsequent positioning of the device upon a trim piece to be marked and cut, the device including a base member defining a slide groove, a lip extending over the slide groove and in part defining a gap, and a first jamb abutment member; and a slide member having a first end slidable within the groove, a tongue insertable within the gap, and a second jamb abutment member; at least one of the base member and the slide member having an end having a 45° angled trim marking edge extending upwards from a bottom portion of the device; whereby, the slide member slides within the groove to where the first and the second abutment members abut opposing jambs and whereby a trim piece is marked and cut upon subsequent positioning of the device.

20 Claims, 10 Drawing Sheets

SLIDING TRIM MARKING DEVICE AND METHOD OF USING SAME

BACKGROUND OF THE INVENTION

1. Field of the Invention

The present invention relates generally to devices for marking trim or molding to be affixed to a jamb, and more specifically, to a device for marking trim on a jamb with a uniform portion of the jamb edge showing.

2. Background Information

Windows and doors used in buildings are routinely supplied as complete units that are secured in openings of appropriate size in the building walls. The doors and windows have an exterior frame or jamb that is secured to the opening to hold the unit in place. The openings in the building walls are larger than the door or window unit jamb to allow for ease of installation and adjustment to provide windows or doors that are "square" and operate without binding. It is common practice to apply decorative trim or molding around the opening once the window or door unit has been installed. The trim is fastened to the edge of the unit jamb and to the surrounding wall to cover any spaces or imperfections close to the opening. To provide a pleasing appearance for the installed trim or molding, the corners where the trim pieces meet are mitered, generally at a 45° degree angle. It is also desirable to position the trim on a jamb with a uniform portion of the jamb edge showing. Thus, the trim pieces are cut larger than the interior dimensions of the jamb to provide the desired exposure of the jamb edges. Installing the trim or molding with mitered corners is exacting work, and can be particularly difficult when a single individual must perform the task.

Some examples of inventions concerned with devices used in carpentry and finishing work for which patents have been granted are found in the following: U.S. Pat. Nos. 6,305,091; 1,634,178; Des 287,944; U.S. Pat. Nos. 1,031,517; 1,192,418; 2,473,639; 3,197,874; 4,989,336; 0,131,486; and 5,737,844.

However, these disclosed devices do not provide for facile marking and positioning of trim or molding. Thus, there is an unmet need for a device for marking and positioning trim with a uniform portion of the jamb edge showing. The device of the present invention meets this need, while providing many additional features that are unique to the structure described herein.

SUMMARY OF THE INVENTION

The present invention is directed to a device for marking trim to be positioned on a jamb, preferably with a uniform portion of the jamb edge showing. In one aspect of the invention, the device includes a base member defining a slide groove; and a slide member slidable within the groove; at least one of the base member and the slide member having an end having a 45° angled trim marking edge extending upwards from a bottom portion of the device, and at least one of the base member and the slide member having a first jamb abutment member; whereby the first jamb abutment member abuts a jamb and the slide member slides within the groove to a trim piece marking position, and whereby the device may be subsequently aligned with a trim piece for marking the trim piece. Preferably the device includes a tightening mechanism to tighten the slide member to the base member, and preferably both the base member and the slide member have a 45° angled trim marking edge and a jamb abutment member.

In a further aspect, the invention includes a trim marking device to gauge the span between opposing jambs for subsequent positioning of the device upon a trim piece to be marked and cut, the device comprising: a base member defining a slide groove, a lip extending over the slide groove and in part defining a gap, and a first jamb abutment member; and a slide member having a first end slidable within the groove, a tongue insertable within the gap, and a second jamb abutment member; at least one of the base member and the slide member having an end having a 45° angled trim marking edge extending upwards from a bottom portion of the device; whereby, the slide member slides within the groove to where the first and the second abutment members abut opposing jambs and whereby a trim piece is marked and cut upon subsequent positioning of the device.

In a further aspect the invention includes a method for marking a trim piece comprising the steps of: providing a trim marking device comprising: a base member defining a slide groove and having a first jamb abutment member; and a slide member slidable within the groove and having a second jamb abutment member; at least one of the base member and the slide member having an end having a 45° angled trim marking edge extending upwards from a bottom portion of the device; sliding the slide member within the groove to abut the first and the second abutment members against opposing jambs; subsequently placing the device upon a trim piece to be marked along the trim marking edge; and marking the trim piece.

The above summary of the present invention is not intended to describe each illustrated embodiment or every implementation of the present invention. The figures and detailed description that follow more particularly exemplify these and additional embodiments.

BRIEF DESCRIPTION OF THE DRAWINGS

The invention may be more completely understood in consideration of the following detailed description of various embodiments of the invention in connection with the accompanying drawings, in which.

Figure 1:
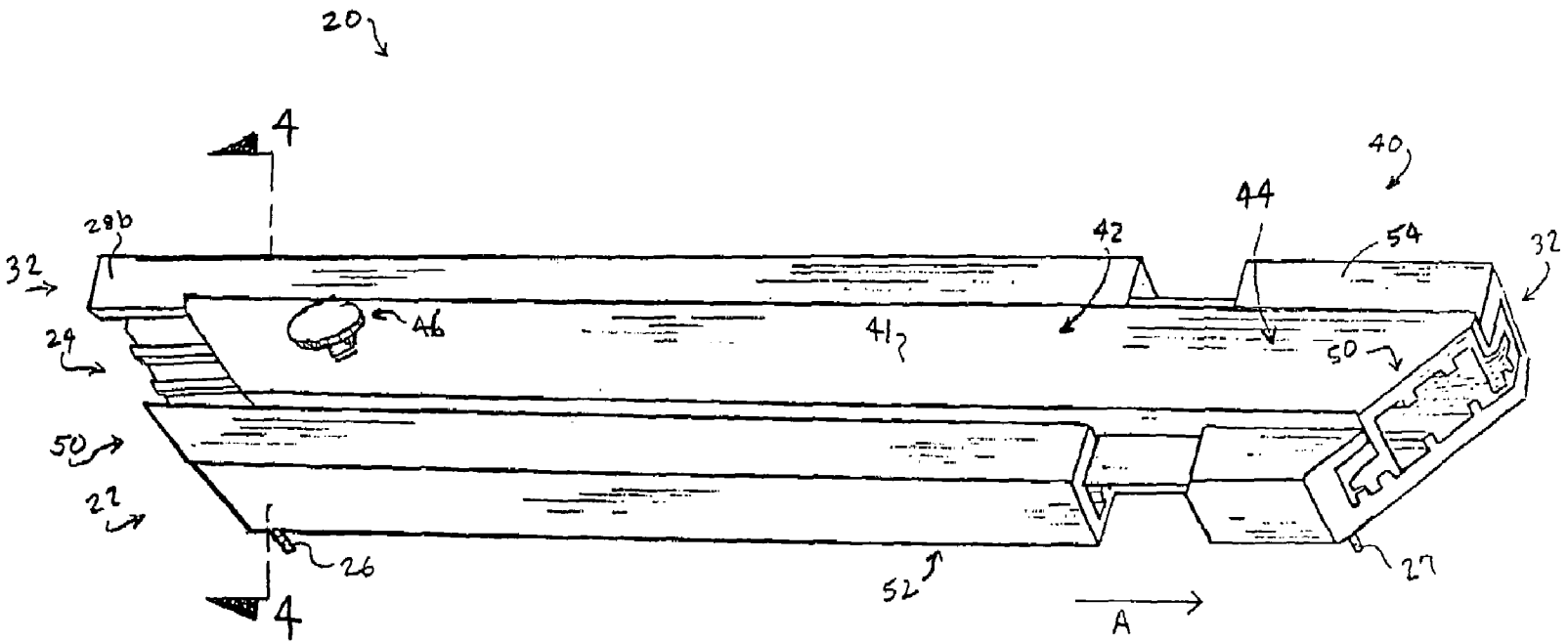
FIG. 1 is a perspective view of the trim marking device according to one aspect of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

DESCRIPTION OF THE EMBODIMENTS

The present invention is directed to a device for marking trim which is to be secured to the jamb of a door, window, or other opening. The device includes features for obtaining a uniform reveal or exposed portion/edge of the jamb when the trim is secured to the jamb. The device obviates the need to measure the distance between opposing jambs between which the trim will be secured, and provides a user with quick and convenient markings. A pair of opposing trim pieces can be quickly marked for appropriate mating.

Referring to FIG. 1, a trim marking device 20 includes a base member 22 and a slide member 40. Base member 22 includes a slide groove 24. Slide groove 24 generally runs longitudinally within base member 22. Base member includes base member body 23 which can be made from rigid material, and preferably from metal and metal alloys, and preferably extruded aluminum or aluminum alloy. Preferably slide groove 24 runs the length of base member 22. Slide groove 24 is configured to receive slide member 40.

Figure 2:
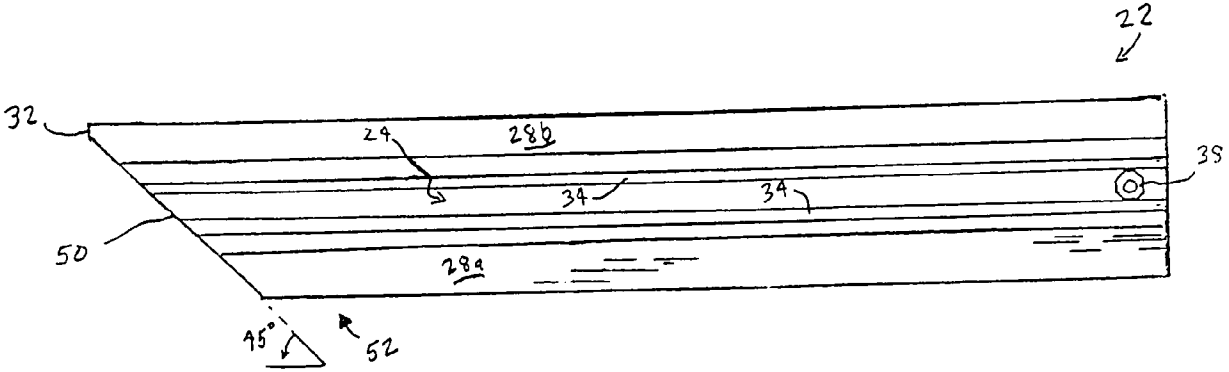
FIG. 2 is a front elevation view of a base member according to one aspect of the invention.
Figure 4:
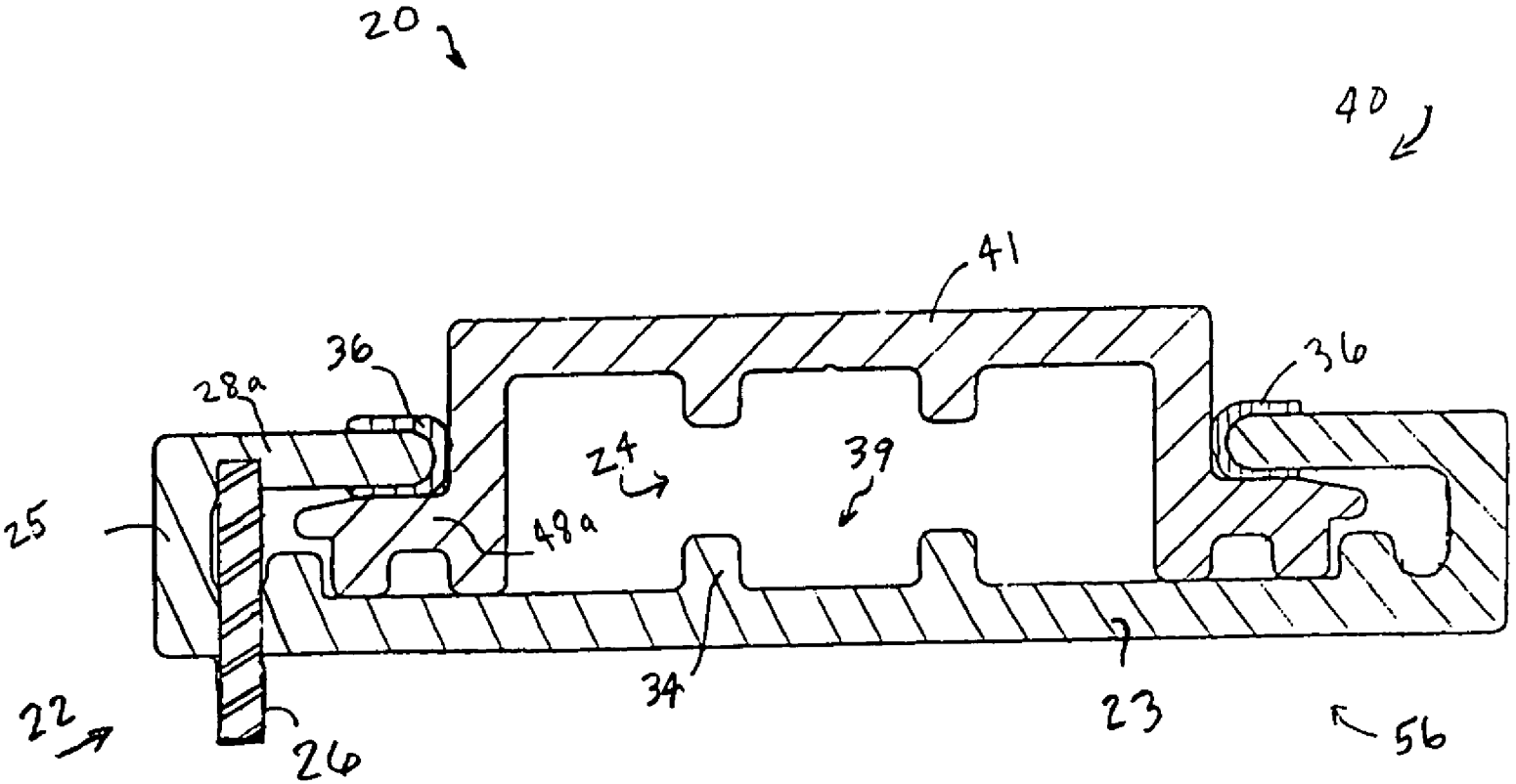
FIG. 4 is a section view taken along the line 4—4 of FIG. 1.
Figure 5:
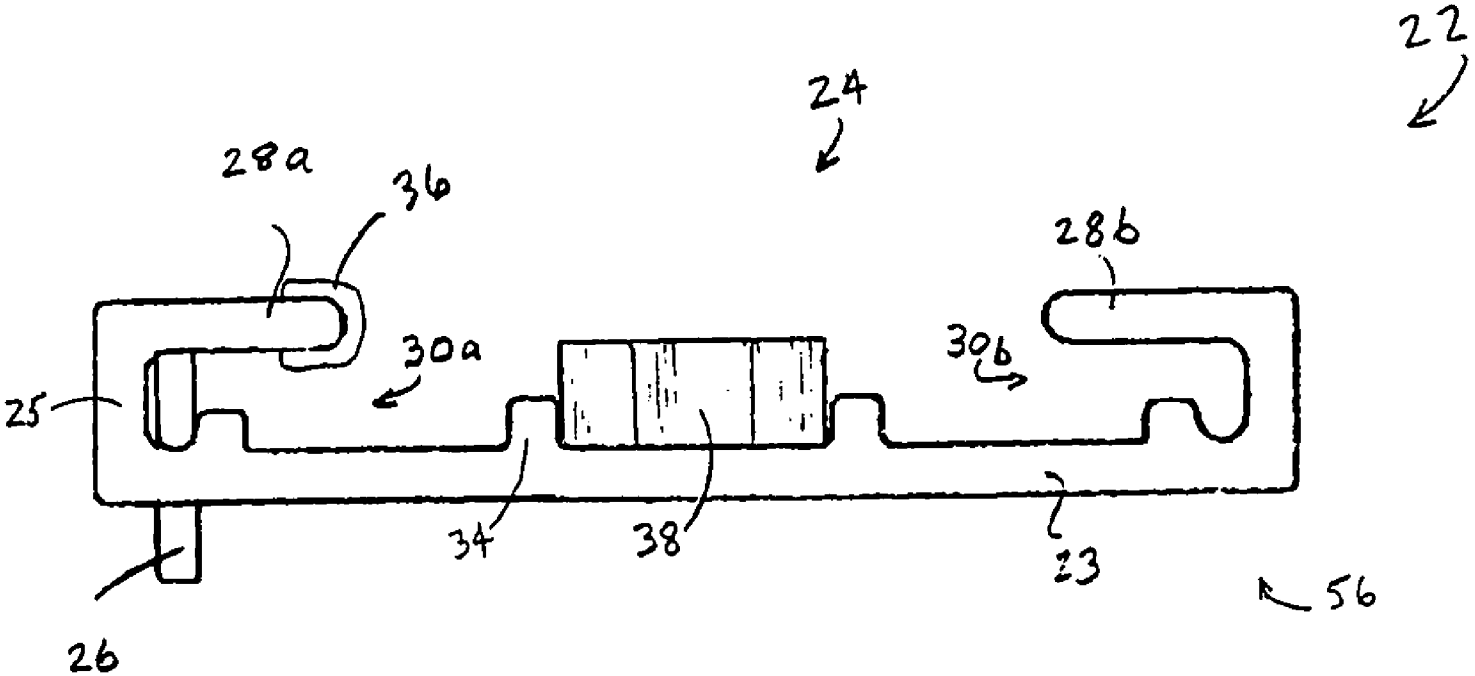
FIG. 5 is a right side view of the member of FIG. 2.

Referring to FIG. 2 and FIG. 5, base member 22 further includes lips 28*a* and 28*b* which define gaps 30*a* and 30*b*. Preferably, lip 28*a* extends generally perpendicular to shoulder 25, which in turn preferably extends generally perpendicular to the wall side 56 of base member 22. A similar configuration with respect to lip 28*b* is provided opposite lip 28*a*. Preferably base member 22 includes ribs 34 which define gutter 39 (see FIG. 4) which preferably runs the length of base member 22. Stopper 38 is positioned in gutter 39 to stop slide member 40 from over-extending beyond base member 22 as described below. Base member body 23 is preferably of a generally uniform thickness to accommodate strength and high-speed production. Base member body 23 has a thickness of approximately ⅛ inch and preferably less than ⅛ inch to allow for a lightweight device. Stopper 38 may include a nut or similar material fitted within gutter 29. Preferably stopper is welded or tack welded in position.

Base member 22 further includes jamb abutment member 26 which extends to a wall side 56 of base member 22. Wall side 56 is that portion of the device which is oriented toward the wall during use. Jamb abutment member 26 may include one from a variety of members extending to the wall side, such as a peg or other protrusion, and preferably is a pin. Abutment member 26 may be a tapered pin or preferably of "C-shaped" variety so that it may expand within a hole (not shown) prepared within base member body 23. Preferably a plastic cap (not shown) is placed over pin 26 to cover sharp edges to protect a user and the wood surface.

Figure 8:
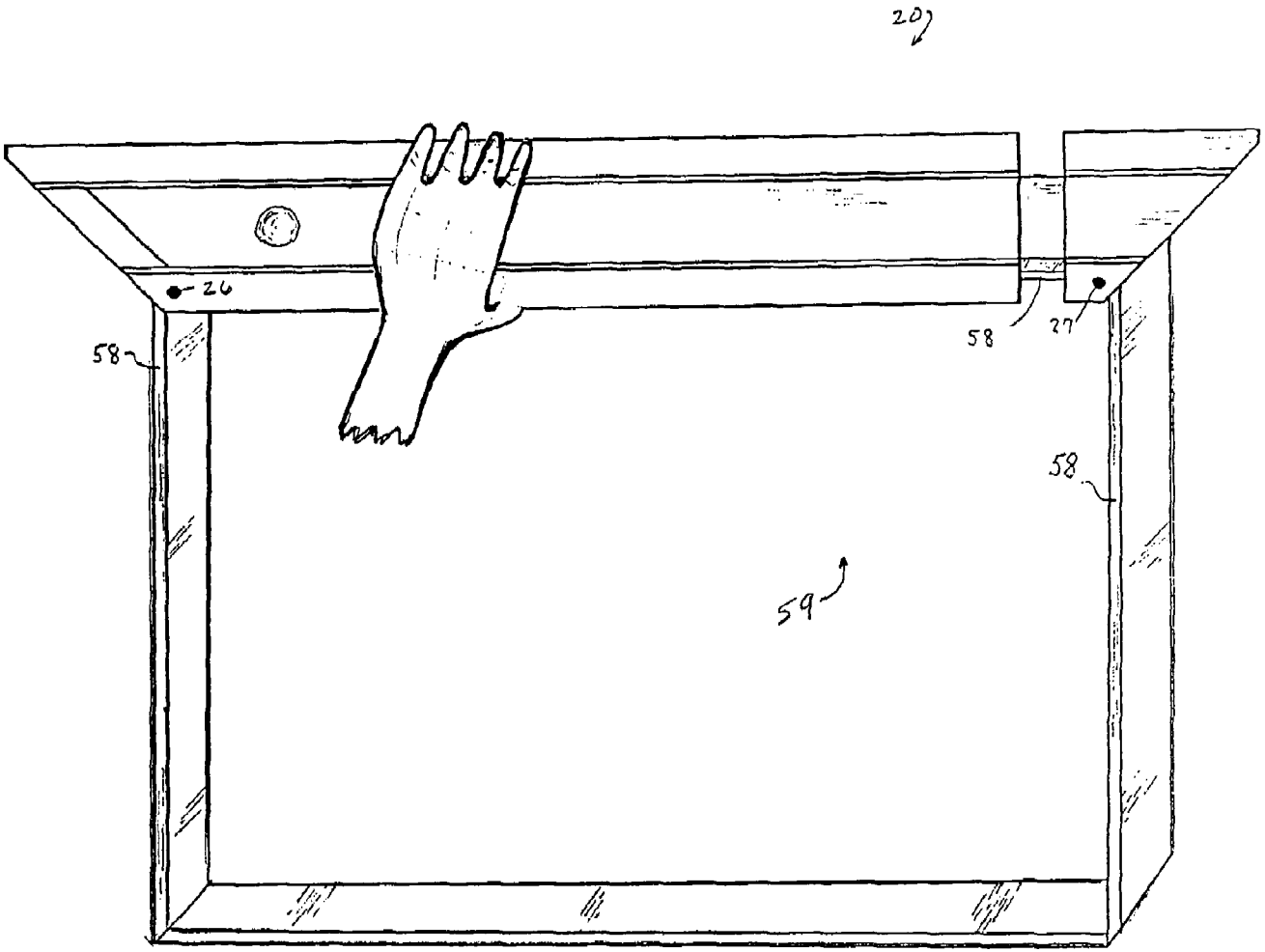
FIG. 8 is a perspective view of a trim marking device according to the present invention.

As shown in FIG. 4, abutment member 26 is mounted to base member body 23 and extends to lip 28*a*. It may be appreciated that abutment member 26 may also extend through lip 28*a* so as to be exposed to the side opposite wall side 56. Preferably abutment member 26 is positioned away from (or adjacent to) shoulder 25 which allows for easier assembly and obviates the need to bore a hold in the structural support of shoulder 25. Jamb abutment member 26 is configured to abut with jambs 58 as shown and described in further detail below (see FIG. 8). Preferably, abutment member 26 extends through lip 28 which provides for a more secure fastening of member 26. Member 26 may extend through base member 22 to the side opposite wall side 56 (i.e. protrudes through lip 28*a* so that it may be visible) as shown in FIG. 8.

Base member 22 preferably has a width of approximately 3 inches. Base member 22 may have a length which varies depending upon the intended use (i.e., whether for doorways or windows of varying lengths). A variety of sizes are preferred, including a preferred set of three sizes so that a worker has available the best tool for the purposes at hand. To work with widely spaced jambs 58, including doorway jambs, (i.e., 6 to 11 feet), the length of the device would be preferably about four feet in length, and thus extend approximately seven feet in length. It may be appreciated that greater lengths and extension spans may be accommodated, taking into account the increased cost and weight of the device. Together with the longer device, a medium length device of about 30 inches in length and a shorter length device of about 18 to 20 inches, all preferably included in a carrying bag, comprise a handy set of devices appropriate for most applications.

Figure 3:
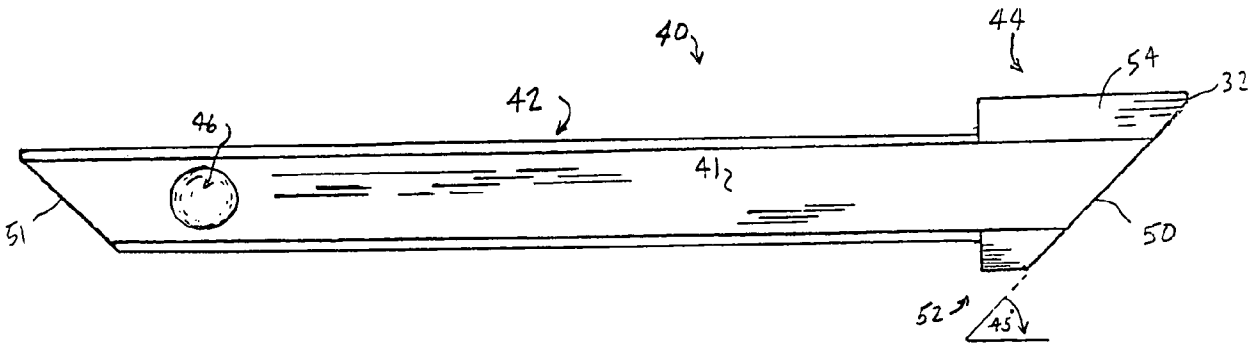
FIG. 3 is a front elevation view of a slide member according to one aspect of the invention.

As shown in FIG. 3 slide member 40 includes slide member body 41 configured to be received within slide groove 24. Slide member 40 includes first end 42 for sliding within groove 24. While not required, first end 42 may have a length equal to the length of slide groove 24 such that when slide member 40 is inserted within base member 22, slide end 51 may be flush with marking edge 50. It can be appreciated that slide end 51 need not be angled but can be most any configuration without diminishing from the invention. Preferably slide end 51 does not extend beyond marking edge 50 of base member 22 so as to avoid interference with alignment or marking of trim. Slide member 40 includes second end 44 configured with head 54. Preferably slide member body 41 insets within head 54 as shown. Slide member 40 further defines marking edge 50 for desired marking of a trim piece. Slide member 40 further includes jamb abutment member 27 disposed at a wall side 56. Preferably jamb abutment member 27 is identical to abutment member 26 and mounted within slide member 40 as abutment member 26 is mounted within base member 22. Base member 22 and slide member 40 may be made of plastic or metal, and preferably base member 22 is made of metal and preferably slide member 40 (and particularly slide member body 41) is made of plastic. Head 54 is preferably made of metal and preferably from the same stock as base member 22 so as to maintain a uniform appearance and smooth abutment with base member 22 when retracted or not extended, and to also accommodate ease of manufacture in connecting slide member body 41 within the groove of head 54.

As shown in FIG. 3, marking edge 50 is configured at a 45° angle extending upwards from a bottom portion 52 of slide member 40. As shown in FIG. 2, marking edge 50 is configured at a 45° angle extending upwards from a bottom portion 52 of base member 22. Having such configuration allows for convenient marking of trim pieces for appropriate marking and fitting of trim about windows, doors or other openings. A user can make a mark using a pencil or other implement by running the pencil along the marking edge in known fashion. No measurement with a ruler or other measuring device is required.

Figure 6:
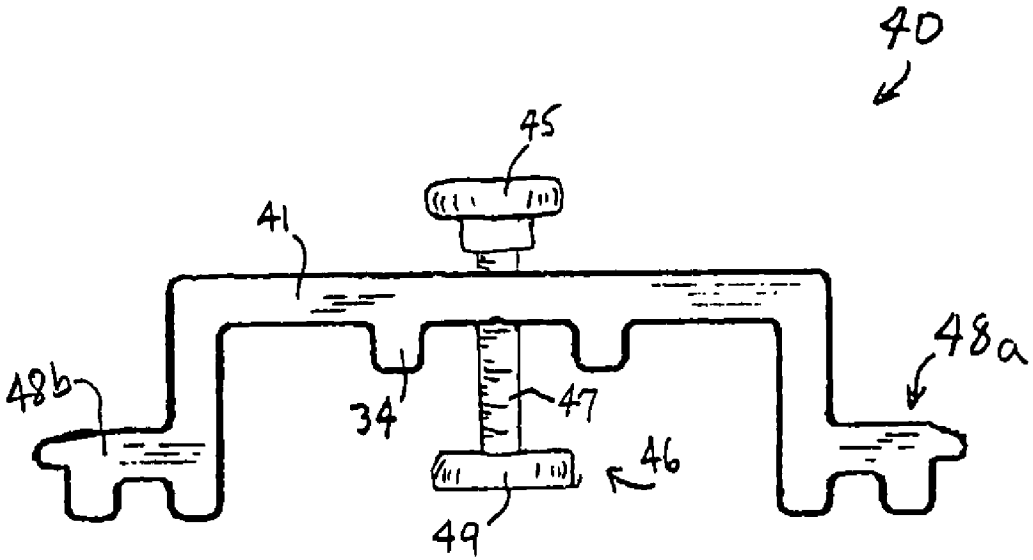
FIG. 6 is a partial left side view of the member of FIG. 3.

As shown in FIG. 6, slide member 40 includes tightening mechanism 46. Tightening mechanism 46 includes knob 45 secured to threaded stud 47 which extends through slide member body 41 toward the wall side 56. Preferably a foot 49 terminates at the end of threaded stud 47. Foot 49 is designed to abut base member 22 at gutter 39 for a friction tightening action. Foot 49 prevents slide member 40 from sliding within slide groove 24 so that a user may appropriately fix the device in a position for appropriate marking.

Having a single knob 45 extending to the side opposite the wall side 56 allows a user to make quick and convenient tightening adjustments. The user may hold the device 20 with one hand and tighten the device with another hand or the same hand. Stud 47 and/or foot 49 also may abut stopper 38 so that slide member 40 is not separated from base member 22 when sliding in the direction of arrow A as shown in FIG. 1.

FIG. 4 depicts slide member 40 inserted within slide groove 24 of base member 22. Tongue 48*a* has position within gap 30*a* and tongue 48*b* is positioned within gap 30*b*. Such positioning allows slide member 40 to slide within slide groove 24 without unwanted displacement. Preferably device 20 includes sleeves 36 which are positioned about lips 28 as best shown in FIG. 4. Sleeves 36 are preferably made of plastic and thereby assist in the sliding action of slide member 40 within slide groove 24. Where slide member 40 and base member 22 are made of metal, sleeve 36 provides for easier operation with plastic sliding on metal as opposed to metal sliding on metal. Sleeve 36 provides a snug fit in order to inhibit slop or rattling of slide member 40 within base member 22. Sleeves 36 generally have a U-shaped cross section. Preferably sleeves 36 run the length of slide groove 24.

Figure 7:
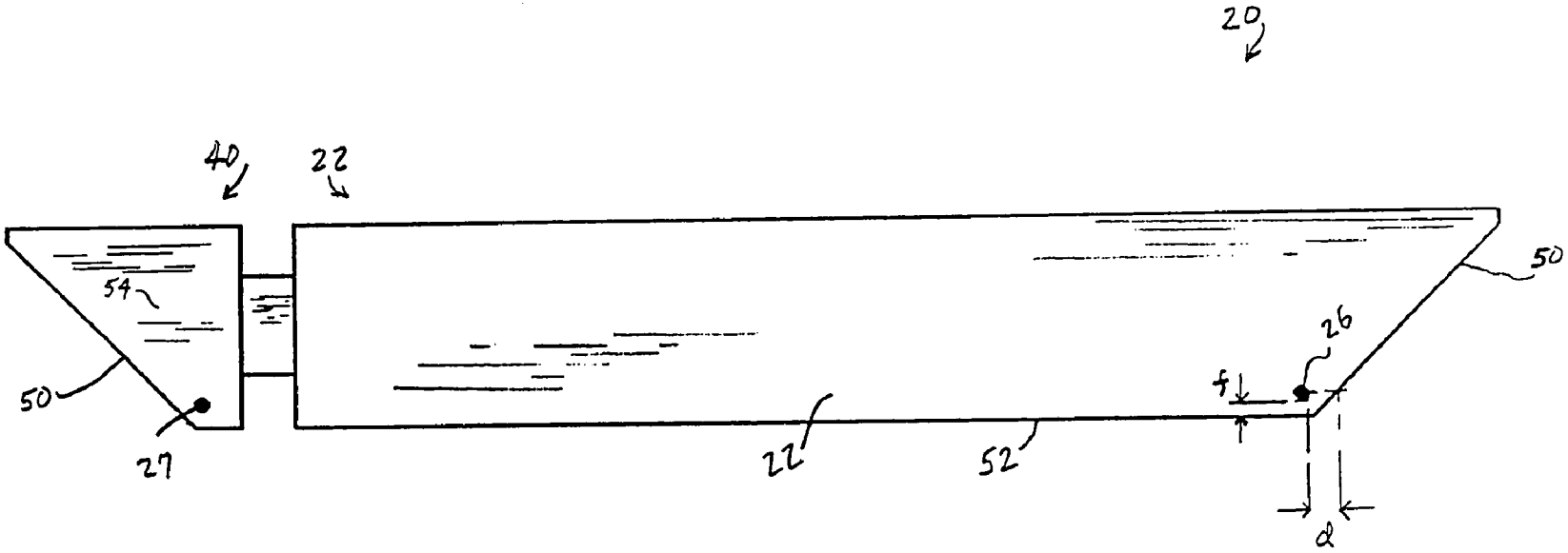
FIG. 7 is a bottom view of the trim marking device according to one aspect of the present invention.

FIG. 7 shows a bottom view of the device according to an aspect of the present invention. Preferably jamb abutment member 26 is offset a distance d such that when abutment member 26 abuts with a jamb 58, a predetermined distance or reveal is obtained. Preferably the distance d equals ⅛ inch thereby resulting in a trim piece having a ⅛ inch offset or reveal. The trim piece would therefore be positioned on the jamb such that a ⅛ inch portion of the jamb remains exposed. Providing a ⅛ inch reveal is often preferred since it gives a customary aesthetic look to trim finishings. As shown, distance d is measured from the surface of pin 26 (pin 26 preferably having a plastic cap, not shown) along the horizontal line projecting to marking edge 50. Abutment member 26 also is positioned a distance f from the bottom portion 52 of base member 22. Preferably, the distance represented by arrow f is ⅛ inch.

In operation, slide member 40 is extended in the direction of arrow A to gauge the span between opposing jambs 58 for subsequent positioning of device 20 upon a trim piece 60 to be marked and cut. Referring to FIG. 8, a user positions device 20 within jamb opening 59. The slide member 40 slides within groove 24 such that abutment members 26 and 27 abut against opposing jambs 58. Preferably, device 20 is placed so a jamb abutment member 26, 27 is positioned into the inside jamb corners defined by intersecting jambs 58. The user subsequently removes the device 20 to be positioned upon a trim piece and marks or scribes the trim piece by running a pen, pencil or other instrument along trim marking edge 50. A user may mark trim piece 60 as it lies on a table or other surface, convenient for cutting. A user may make markings at both marking edges 50 to assure an appropriate length of trim. Preferably a user will operate tightening mechanism 46 when abutment members 26, 27 are in abutting position with opposing jambs 58, thereby "locking" the device to the appropriate trim piece marking position. Thus, slide member 40 will not be altered when the user removes the device for marking purposes. Further, and especially when marking trim for windows, a user can mark two trim pieces 60 in succession without measuring or re-gauging the span. This conveniently saves a further step in the trim work process and assures that opposing trim pieces are of equal distance. A user may subsequently release tightening mechanism 46 so as to position slide member 40 in a new location to accommodate the gauging between a new set of opposing jamb members, or to fix the device 20 in a retracted position for transport or storage.

Device 20 further includes stubs 32 positioned on either base member 22 or slide member 40, or preferably both. Stub 32 is provided where the device would have a pointed feature which would otherwise pose safety risks or scratching. Further, stub 32 provides a ground positioning feature such that device 20 may conveniently be operated for gauging the span of a doorway from the floor to the upper doorway jamb. Stub 32 can be of varying length such as that shown in FIG. 3, however, it is preferably approximately ¾ inch as shown in FIG. 1.

Figure 9:
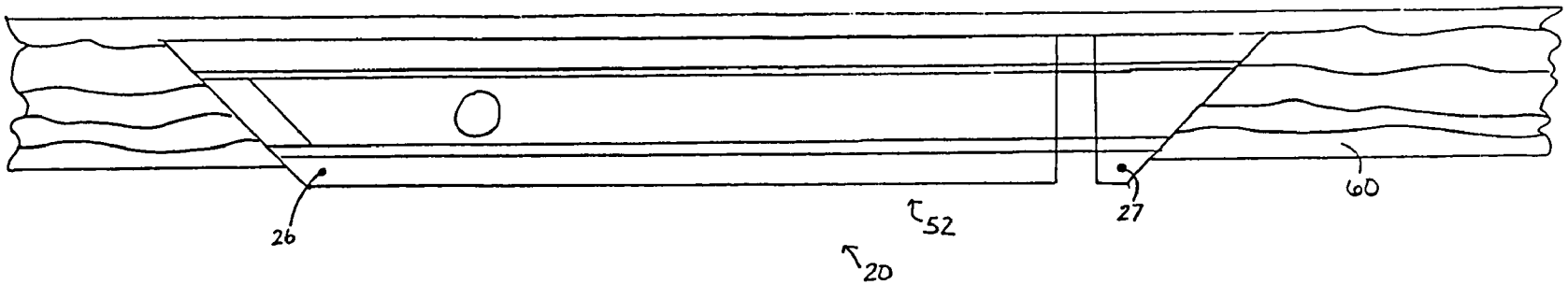
FIG. 9 is a plan view of a trim marking device according to the present invention.

As shown in FIG. 9, device 20 is placed upon trim piece 60 with abutment members 26 and 27 abutting a bottom edge of trim piece 60. Abutment members 26, 27 extend to the wall side 56 of device 20. As depicted in FIG. 9, abutment members 26, 27 are also visible from the side opposite the wall side 56. Alternatively, abutment members 26, 27 need not be visible to the side opposite the wall side 56, however manufacturing is convenient if members 26, 27 run through base member 22. Preferably, members 26, 27 extend approximately ⅜ inches from base member 22 toward wall side 56.

Head 54 may be made of stock similar or identical to the stock used for making base member 22. Head 54 is connected to slide member 40 by a tack weld or other similar pin or screw. Foot 49 is preferably configured so that it abuts stopper 38 when slide 40 is extended from slide groove 24 in the direction of arrow A. This prevent separation of slide member 40 from base member 22. Ribs 34 are configured to accommodate structural integrity and ease of extruding manufacture, as well as guides for positioning stopper 38 and tightening mechanism 46. In operation, a user can quickly release tightening mechanism 46 while sliding slide member 40.

When trim piece 60 is marked and cut, and on account of the 45 degree angle, piece 60 will have a minor length which is positioned toward the bottom portion 52, and a major length which is longer than the minor length and is positioned opposite thereto. The minor length of a cut trim 60 has a length approximately ¼ inch greater than the distance between opposing jambs.

Figure 10:
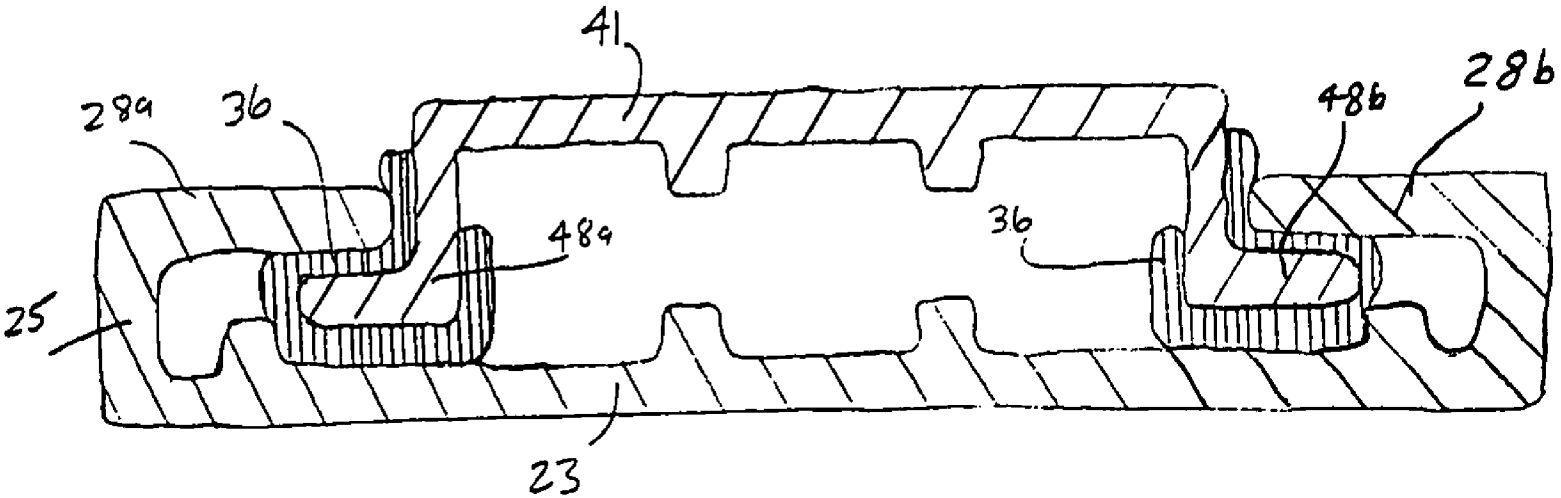
FIG. 10 is a section view of a further aspect of the invention.
Figure 11:
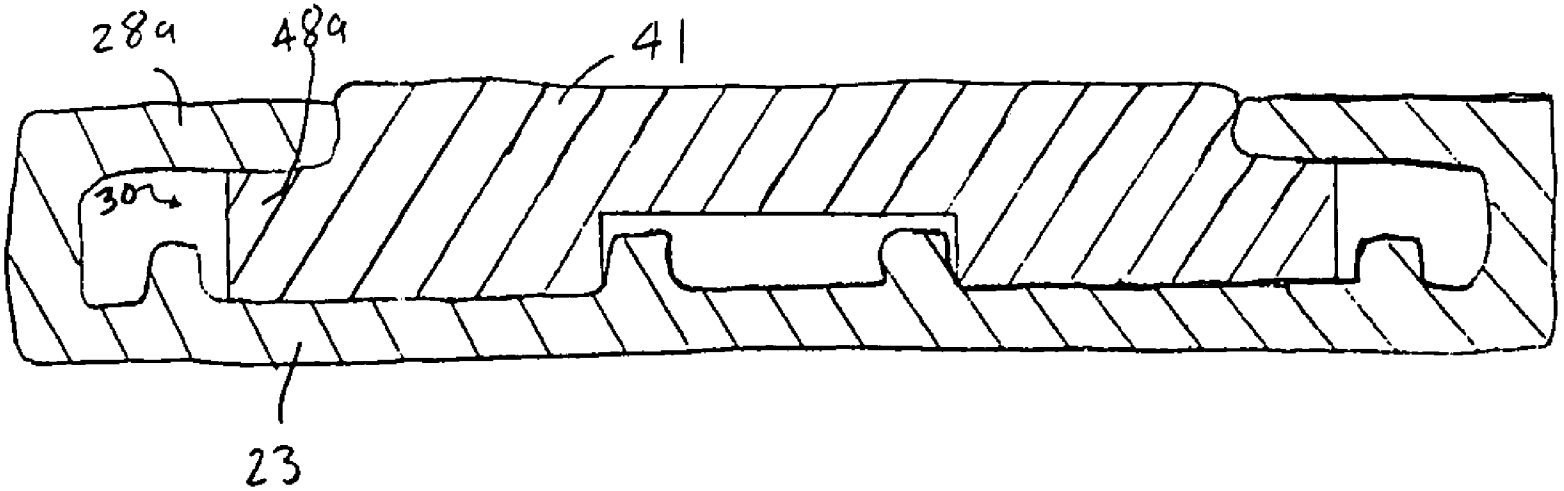
FIG. 11 is a section view of a further aspect of the invention.

FIG. 10 includes an alternative aspect of slide member body 41 and sleeve 36. In this aspect, body 41 and member 23 may be made of metal, and sleeve 36 is made of plastic. Sleeve 36 is configured to wrap about tongue 48 to eliminate metal-to-metal contact which otherwise may result in binding. FIG. 11 shows a further and preferred alternative aspect of slide member body 41, preferably made from plastic. Such configuration as shown eliminates metal-to-metal contact to reduce binding.

While the present invention has been described with reference to several particular example embodiments, those skilled in the art will recognize that many changes may be made thereto without departing from the spirit and scope of the present invention, which is set forth in the following claims.

I claim:

1. A trim marking device comprising:

a base member defining a slide groove; and a slide member slidable within said groove;

at least one of said base member and said slide member having an end having a 45° angled trim marking edge extending upwards from a bottom portion of said device, and at least one of said base member and said slide member having a first jamb abutment pin;

whereby said first jamb abutment pin abuts a jamb and said slide member slides within said groove to a trim piece marking position, and whereby said device may be subsequently aligned with a trim piece for marking the trim piece.

2. The trim marking device of claim 1, wherein said slide member includes a first end slidable within said groove and a second end which defines said 45° angled trim marking edge.

3. The trim marking device of claim 2, wherein said first end of said slide member has a length no greater than the length of said groove.

4. The trim marking device of claim 1, wherein said device further includes a tightening mechanism to tighten said slide member to said base member.

5. The trim marking device of claim 4, wherein said tightening mechanism includes a threaded stud disposed in said slide member and a knob projecting opposite said abutment pin.

6. The trim marking device of claim 1, wherein each of said base member and said slide member includes a 45° angled trim marking edge extending upwards from a bottom portion of said device.

7. The trim marking device of claim 1, wherein said base member includes a lip projecting toward said slide groove and in part defining a gap, and said slide member includes a tongue insertable within said gap.

8. The trim marking device of claim 7, wherein said device further includes a sleeve positioned over said lip.

9. The trim marking device of claim 7, wherein said device further includes a sleeve positioned over said tongue.

10. The trim marking device of claim 1, wherein said jamb abutment member pin is positioned a distance of approximately ⅛" from said angled trim marking edge.

11. A trim marking device comprising:

a base member defining a slide groove; and a slide member slidable within said groove;

at least one of said base member and said slide member having an end having a 45° angled trim marking edge extending upwards from a bottom portion of said device, said base member having a first jamb abutment member, said slide member having a second jamb abutment member.

12. The trim marking device of claim 11, wherein the first abutment member includes a pin extending outward on a wall side of said base member and said second abutment member includes a pin extending outward on a wall side of said slide member.

13. The trim marking device of claim 11, wherein said first and said second abutment members are positioned on said base member and said slide member such that a resulting cut trim piece has a minor length greater than the distance between opposing jambs.

14. A trim marking device to gauge the span between opposing jambs for subsequent positioning of the device upon a trim piece to be marked and cut, the device comprising:

a base member defining a slide groove, a lip extending over said side groove and in part defining a gap, and a first jamb abutment member; and a slide member having a first end slidable within said groove, a tongue insertable within said gap, and a second jamb abutment member;

at least one of said base member and said slide member having an end having a 45° angled trim marking edge extending upwards from a bottom portion of said device;

whereby, said slide member slides within said groove to where said first and said second abutment members abut opposing jambs and whereby a trim piece is marked and cut upon subsequent positioning of said device.

15. The trim positioning device according to claim 14, wherein said base member has a generally C-shaped cross section.

16. The trim positioning device according to claim 14, wherein each of said base member and said slide member includes a 45 angled trim marking edge extending upwards from a bottom portion of said device and wherein said jamb abutment member is positioned a distance of approximately ⅛" from said angled trim marking edge.

17. A method for marking a trim piece comprising the steps of:

(a) providing a trim marking device comprising:

(i) a base member defining a slide groove and having a first jamb abutment member; and (ii) a slide member slidable within said groove and having a second jamb abutment member; at least one of said base member and said slide member having an end having a 45° angled trim marking edge extending upwards from a bottom portion of said device;

(b) sliding said slide member within said groove to abut said first and said second abutment members against opposing jambs;

(c) subsequently placing said device upon a trim piece to be marked along said trim marking edge; and (d) marking the trim piece.

18. The method according to claim 17 wherein said device further includes a tightening mechanism and wherein said method further includes the step of tightening said slide member in a fixed position prior to placing said device upon the trim piece.

19. The method according to claim 17 wherein said step of sliding said slide member includes positioning said first and said second abutment members in jamb corners.

20. The method according to claim 17 wherein said step of placing said device upon a trim piece to be marked includes abutting the trim piece against said first and said second abutment members.

* * * * *